US007612274B2

(12) United States Patent
Nakata

(10) Patent No.: US 7,612,274 B2
(45) Date of Patent: Nov. 3, 2009

(54) ELECTRONIC MUSICAL INSTRUMENT

(75) Inventor: Takuya Nakata, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/116,619

(22) Filed: May 7, 2008

(65) Prior Publication Data

US 2008/0276788 A1 Nov. 13, 2008

(30) Foreign Application Priority Data

May 8, 2007 (JP) ..... 2007-122976

(51) Int. Cl.
*G10D 13/02* (2006.01)

(52) U.S. Cl. ..... 84/423 R

(58) Field of Classification Search ..... 84/423 R, 84/327, 421

See application file for complete search history.

(56) References Cited

U.S. PATENT DOCUMENTS 7,086,632 B2 * 8/2006 Hsieh ..... 248/188.1
2007/0017337 A1 1/2007 Sugimoto et al.

FOREIGN PATENT DOCUMENTS

| | | | |
|---|---|---|---|
| JP | 1-43756 | Y2 | 12/1989 |
| JP | 6-21092 | U | 3/1994 |
| JP | 2007-25442 | A | 2/2007 |

* cited by examiner

*Primary Examiner*—Kimberly R Lockett
(74) *Attorney, Agent, or Firm*—Rossi, Kimms & McDowell LLP

(57) ABSTRACT

To the undersurface of a main body 10 having a keyboard 12 operated with player's hands, upper stand portions 72 which are tilted backward and are shaped like a tube are fixed. Lower stand portions 74 are shaped like a tube which is slightly smaller than the upper stand portions 72. The top end of the lower stand portion 74 is inserted into the upper stand portion 72. If the lower stand portions 74 are inserted into the upper stand portions 72 further deeply, the main body 10 is lowered with the main body 10 moving frontward. As a result, even in a case where a player 90 sits on a sofa or the like, the player 90 is allowed to play an instrument in a comfortable posture.

9 Claims, 7 Drawing Sheets

ELECTRONIC MUSICAL INSTRUMENT

This application is based on and claims priority to Japanese Patent Application No 2007-122976, filed on May 8, 2007. The disclosure of the priority application, in its entirety, including the drawings, claims, and the specification thereof, is incorporated herein by reference.

BACKGROUND OF THE INVENTION

1. Field of the Invention

The present invention relates to an electronic musical instrument such as an electronic piano and an electronic organ.

2. Description of the Related Art

Electronic keyboard instruments such as an electronic piano and an electronic organ are played by users of various physiques from adults to children. Therefore, there have been electronic keyboard instruments which allow users to adjust dimensions of the instruments according to physique of the users. For instance, Japanese Unexamined Utility Model Publication No. 6-21092 discloses an electronic keyboard instrument having a pedal unit including a pedal keyboard or the like, the electronic keyboard instrument allowing upward and downward adjustment of the mounted position of the pedal unit.

Electronic keyboard instruments are designed to allow users to adjust dimensions in order not only to suit their various physiques but also to adapt to various life styles in which users enjoy playing the electronic keyboard instruments. For example, Japanese Unexamined Patent Publication No. 2007-025442 discloses an electronic keyboard instrument which is designed such that the height of the keyboard from floor is about the same as the height of a low table (350 to 500 mm) in order to allow a user to play the electronic keyboard instrument in a state where the user sits on a sofa or floor, taking his ease. In order to allow the user to play the electronic keyboard instrument also while sitting on a commonly used stool (height of about 450 mm) designed to be used when a user plays a keyboard instrument, the electronic keyboard instrument disclosed in Japanese Unexamined Patent Publication No. 2007-025442 is designed to allow mounting of additional legs having a certain height (height of about 300 mm).

DISCLOSURE OF THE INVENTION

Problem to Be Solved by the Invention

In a case where children play the disclosed former conventional keyboard instrument, however, their legs cannot reach the floor to remain in the air, so that they cannot brace themselves. As a result, the above-described conventional art presents a problem that the players cannot operate the pedals or the pedal keyboard in a stable state. Furthermore, the latter conventional art presents a problem that handleability of the disclosed electronic keyboard instrument is poor, for the users are required to mount or remove the additional legs each time they desire to change the height of the electronic keyboard instrument. In a case where the user sits on a sofa to take his ease, in addition, the user usually sits back on the sofa to lean against a backrest of the sofa. In this case, shoulders of the user move backward, resulting in his hands also moving backward when he stretches his arms forward. Therefore, it is desired that the user is allowed to adjust the front-back directional position of the keyboard and the like according to how the user sits on a sofa or the like.

The present invention was accomplished to solve the above-described problems, and a first object thereof is to provide an electronic musical instrument which allows any users from adults to children to play the instrument in a stable posture without requiring the users to mount or remove supplemental parts such as additional legs. A second object of the present invention is to provide an electronic musical instrument which allows the users to play the instrument in a comfortable posture even in a case where the users sit on a common stool designed to be used when a user plays a keyboard instrument as well as in a case where the users sit on a sofa or the like to take their ease.

In order to achieve the above-described objects, an electronic musical instrument according to the present invention includes a main body having a keyboard operated with player's hands; a lower stand portion being placed on a floor; an upper stand portion supporting the main body at an upper portion of the upper stand portion, the upper stand portion being displaceably supported at a lower portion of the upper stand portion by the lower stand portion so that a height measured from the floor to the main body can be changed, the upper stand portion being designed such that the main body moves diagonally frontward if the height from the floor to the main body is lowered; and fixing means for fixing the upper stand portion to the lower stand portion so that the upper stand portion cannot be displaced after the height from the floor to the main body has been changed.

In this case, the lower stand portion and the upper stand portion are provided on both right and left sides, respectively, as pairs for example. Furthermore, for example, the closer to the top of the lower stand portion, the more the lower stand portion is tilted diagonally backward; and the upper stand portion is mounted on the lower stand portion so that the upper stand portion can be displaced in a direction in which the lower stand portion extends. In addition, the fixing means is a connecting member which connects the upper stand portion to the lower stand portion so that the lower stand portion and the upper stand portion cannot be displaced, respectively, for example. Furthermore, the fixing means may be a gas cylinder which connects the upper stand portion to the lower stand portion.

Furthermore, an electronic musical instrument according to the present invention further includes a pedal mounted on the lower stand portion and operated with a player's foot. In this case, the pedal is at least one of a damper pedal, a soft pedal, a sostenuto pedal, an expression pedal and a pedal keyboard.

The present invention configured as described above allows a user to change the height of the main body from the floor with the main body being fixed at the changed height. As a result, the present invention enables any users from adults to children to play the electronic musical instrument in a stable posture without the need for attaching or removing supplemental parts such as additional legs. If the main body is lowered, furthermore, the main body moves frontward. Even in a case where a user sits on a sofa or the like to take his ease, therefore, the user is allowed to play the electronic musical instrument in a comfortable posture.

Figure 1:
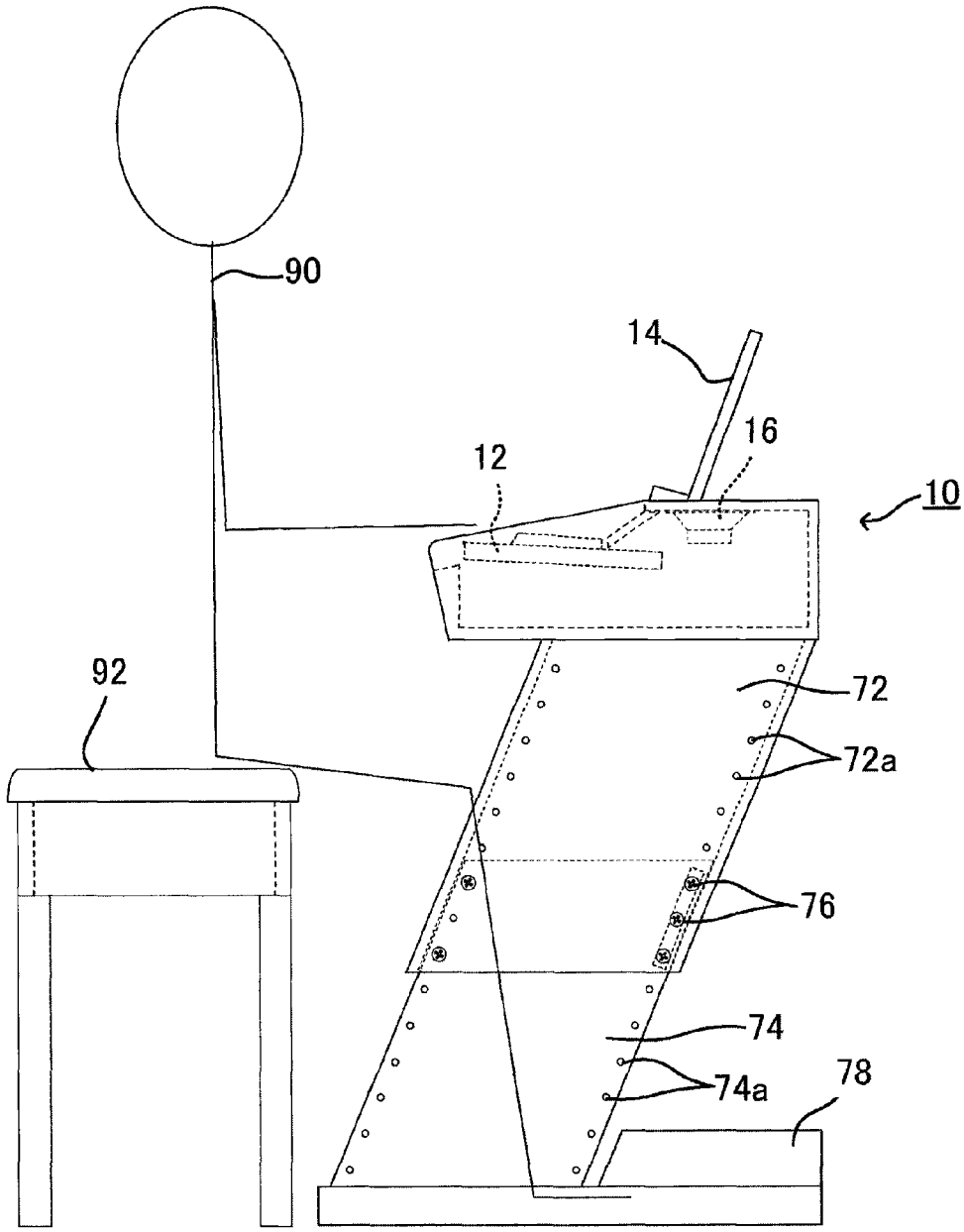
FIG. 1 is a right side view of an electronic keyboard instrument according to a first embodiment of the present invention.

DESCRIPTION OF THE PREFERRED EMBODIMENT a. First Embodiment

An electronic keyboard instrument (electronic piano) according to a first embodiment of the present invention will be described with reference to FIGS. 1 and 2. A main body 10 has a keyboard 12 which is operated with hands, a music stand 14, a speaker 16, an electronic tone generator and various kinds of electric circuits (not shown). Upper stand portions 72 are provided on both sides of the main body 10 to form a pair. Each of the upper stand portions 72 is formed like a tube having an approximately rectangular cross-section. Each of the upper stand portions 72 is inclined more backward (toward the right in the figure) as nearing the top of the upper stand portion 72. The top end of the respective upper stand portions 72 is fixed to the undersurface of the main body 10 to support the main body 10. Lower stand portions 74, which are placed on a floor, are provided on both sides of the main body 10 in a pair similarly to the upper stand portions 72. Each of the lower stand portions 74 is formed like a tube having an approximately rectangular cross-section which is slightly smaller than that of the upper stand portions 72. Each of the lower stand portions 74 is inclined more backward as nearing the top of the lower stand portion 74. The top end of the lower stand portion 74 is inserted into the upper stand portion 72. The upper stand portions 72 and the lower stand portions 74 may be designed such that the lower stand portions 74 have an approximately rectangular cross-section which is slightly larger than that of the upper stand portions 72 so that the lower end of the upper stand portion 72 is inserted into the lower stand portion 74.

On the front part and the rear part of the side surface of the respective upper stand portions 72, a plurality of screw holes 72*a*, . . . , 72*a* are provided along a diagonally upward/downward direction at regular intervals. On the lower stand portions 74 as well, a plurality of screw holes 74*a*, . . . , 74*a* are provided at locations opposed to the screw holes 72*a*, 72*a*. Each of screws 76, . . . , 76 penetrates any of the screw holes 72*a*, 72*a* of the upper stand portions 72 and any of the screw holes 74*a*, . . . , 74*a* of the lower stand portions 74, respectively, so that the screw 76 is engaged with the screw hole 72*a* and the screw hole 74*a*. As a result, the upper and lower stand portions 72, 74 are fixed at the shown position. The screws 76, . . . , 76 may be replaced with connecting members such as pins each of which penetrates any of the screw holes 72*a*, . . . , 72*a* of the upper stand portions 72 and any of the screw holes 74*a*, . . . m 74*a* of the lower stand portions 74. Furthermore, any kind of connecting members other than the screws 76 and the pins may be employed as long as the connecting member can connect the upper stand portion 72 to the lower stand portion 74 so that the upper and lower stand portions 72, 74 cannot be displaced. As a result, the upper and lower stand portions 72, 74 also serve as a guide mechanism which guides the main body 10 in a diagonal direction so that the main body 10 moves frontward if the main body 10 is lowered. A bar member 78 is fastened to the lower stand portions 74 of the both sides, so that the lower stand portions of the both sides are made to have a certain interval. A stool 92 commonly used when a user plays a keyboard instrument is allowed to adjust the height of the stool in a range of "450 to 560 mm", for example.

In FIG. 1, the main body 10 and the stool 92 are adjusted to have a height suitable for an adult player 90. FIG. 2 shows a front view of this electronic keyboard instrument. FIG. 3 shows a side view of a case where the user unscrews the screws 76, . . . , 76 to further deeply insert the lower stand portions 74 into the upper stand portions 72, and then fastens the upper and lower stand portions 72, 74 with the screws 76, . . . , 76 again. In FIG. 3, the main body 10 and the stool 92 are adjusted to have a height suitable for a child player 94.

As described above, the first embodiment eliminates the need for attaching and removing supplemental parts such as additional legs, allowing any players from adults to children to play the keyboard instrument in a stable posture. In a case of a piano, particularly, it is known that loudness obviously varies depending on whether the user is allowed to take a posture which enables the user to brace himself. As the first embodiment, therefore, it is desired that even children can play the keyboard instrument in a posture which enables the children to stably brace themselves.

b. Second Embodiment

An electronic keyboard instrument according to a second embodiment of the present invention will be described with reference to FIG. 4. Although the electronic keyboard instrument according to the second embodiment has almost the same configuration as that of the electronic keyboard instrument according to the first embodiment, a pedal unit 80 is fastened to the bar member 78 in the second embodiment. The pedal unit 80 is equipped with a plurality of pedals operated with a player's foot such as damper, soft and sostenuto. As in the case of FIG. 1, the main body 10 and the stool 92 shown in FIG. 4 are adjusted to have a height suitable for the adult player 90.

Figure 2:
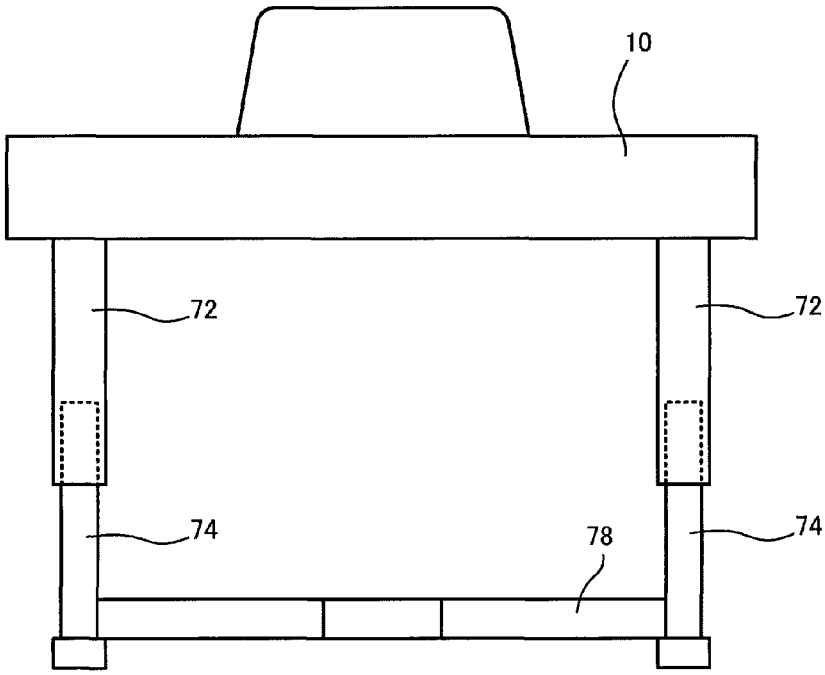
FIG. 2 is a front view of the electronic keyboard instrument according to the first embodiment.
Figure 3:
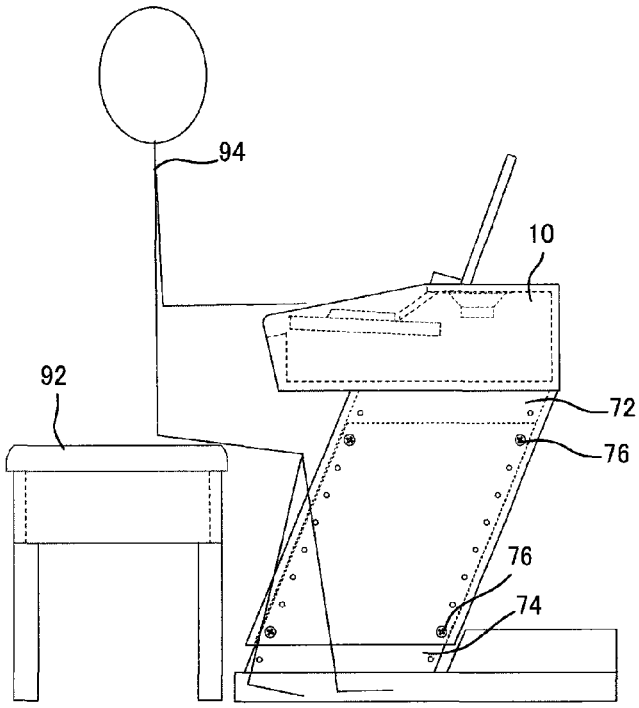
FIG. 3 is a right side view of the electronic keyboard instrument according to the first embodiment, the view showing the electronic keyboard instrument after the height thereof has been changed.
Figure 5:
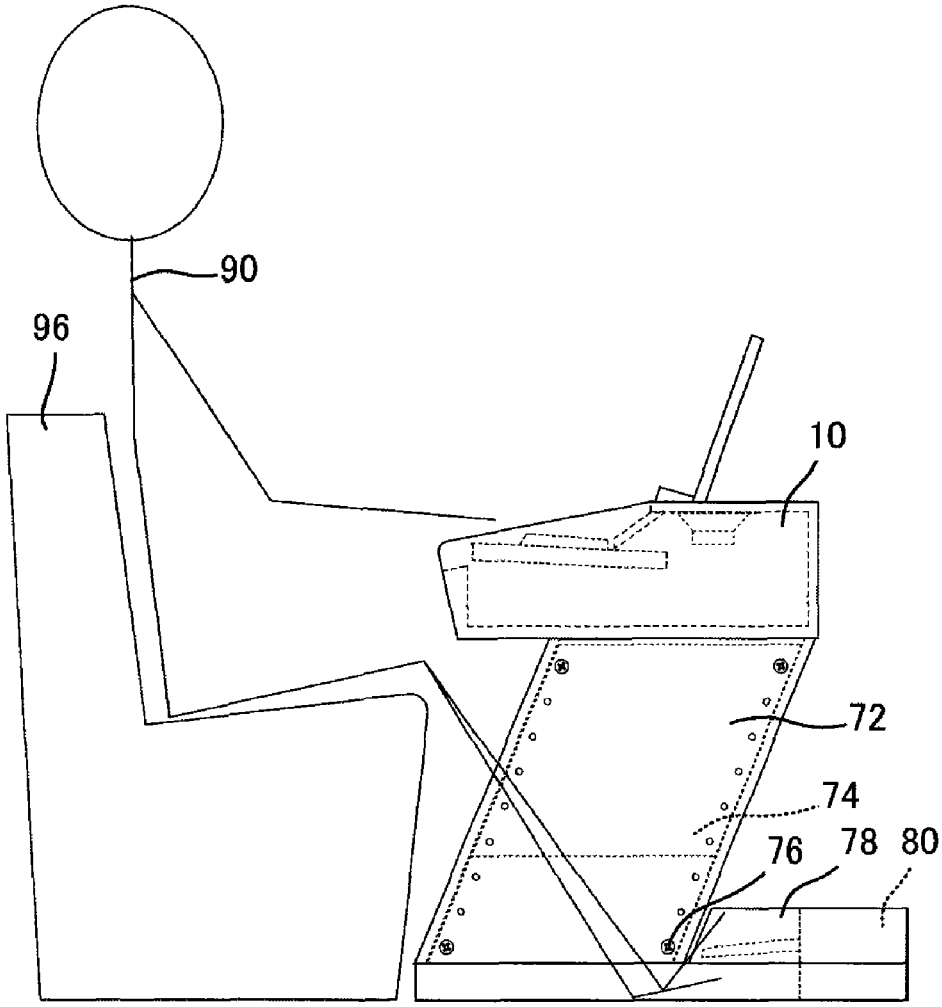
FIG. 5 is a right side view of the electronic keyboard instrument according to the second embodiment, the view showing the electronic keyboard instrument after the height thereof has been changed.

Similarly to the case of FIG. 2, FIG. 5 shows a side view of a case where the user further deeply inserts the lower stand portions 74 into the upper stand portions 72, and then fastens the upper and lower stand portions 72, 74 with the screws 76, . . . , 76. In this case, the adult player 90 is sitting on a sofa 96 in a relaxed posture. More specifically, the player 90 sits back on the sofa 96, slightly leaning against a backrest of the sofa 96 and naturally stretching his both legs forward.

According to the second embodiment, as described above, in both cases where the player 90 sits on the stool 92 commonly used when a player plays a keyboard instrument and on the sofa 96, the player 90 is allowed to play the keyboard instrument in a stable posture without the need for attaching or removing supplemental parts such as additional legs.

Figure 4:
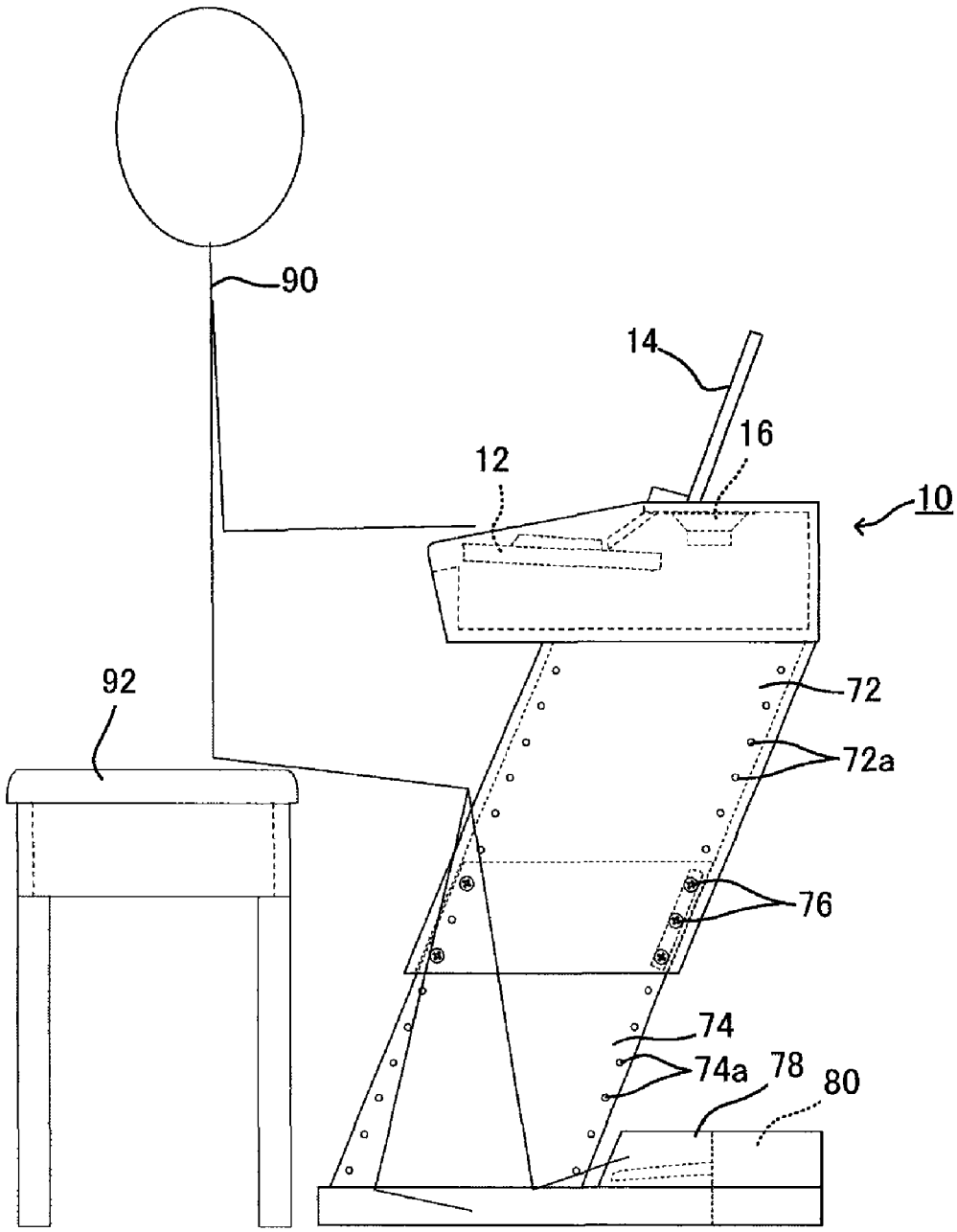
FIG. 4 is a right side view of an electronic keyboard instrument according to a second embodiment.

In the second embodiment, furthermore, because the upper and lower stand portions 72, 74 are tilted more backward as nearing the top thereof, the main body 10 is moved frontward (toward the left in the figure) with respect to the pedal unit 80 in FIG. 5, compared to FIG. 4. In other words, the position of the pedal unit 80 is moved away in the backward direction with respect to the position of the main body 10 (the keyboard 12 in particular). Even in a state where the player 90 sits on a chair having a low bearing surface and stretches his legs to get relaxed, as a result, the player 90 is allowed to play the electronic keyboard instrument in a comfortable posture.

c. Third Embodiment

Figure 6:
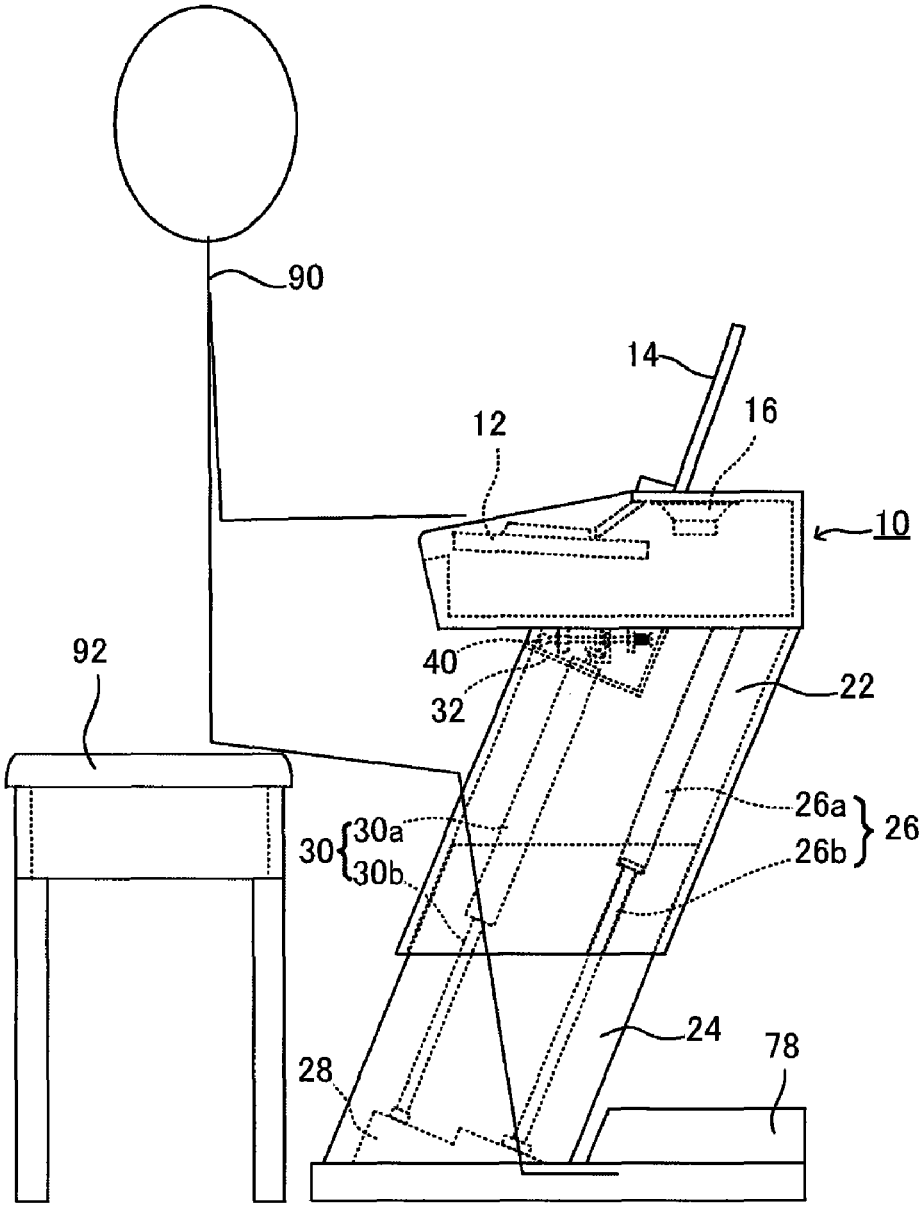
FIG. 6 is a right side view of an electronic keyboard instrument according to a third embodiment.

An electronic keyboard instrument according to a third embodiment of the present invention will be described with reference to FIG. 6. Although the main body 10 is almost the same as the main body 10 of the first embodiment, the upper and lower stand portions 72, 74 of the first embodiment are replaced with a pair of upper stand portions 22 and lower stand portions 24 provided on the both sides in the third embodiment. In FIG. 6, members equivalent to those shown in FIG. 1 are numbered similarly to FIG. 1. The upper and lower stand portions 22, 24 have the same shape as that of the upper and lower stand portions 72, 74 of the first embodiment. The upper stand portions 22 are fixed to the main body 10 to support the main body 10, while the lower stand portions 24 are placed on a floor. Although the lower stand portions 24 are inserted into the upper stand portions 22, anything equivalent to the screw holes 72*a*, 74*a* is not provided on the upper and lower stand portions 22, 24.

At the lower part of the inside of the respective lower stand portions 24 of both sides, a sawtooth base 28 is provided. In FIG. 6, however, the upper and lower stand portions 22, 24 of the right side and the base 28 provided for the lower stand portion 24 of the right side are shown. Between the main body 10 and the base 28, a gas cylinder 30 is provided. The gas cylinder 30 is formed of an approximately tubular cylinder portion 30*a* and an approximately cylindrical piston portion 30*b* jutting downward from the cylinder portion 30*a*. In the gas cylinder 30, the piston portion 30*b* is continuously urged by inner gas pressure of the cylinder portion 30*a* to protrude from the cylinder portion 30*a*. The gas cylinder 30 allows move of gas contained in the cylinder portion 30*a* during depression of a later-described gas control pin 30*d*, so that the piston portion 30*b* can get into or out of the cylinder portion 30*a*. As a result, more specifically, the length of the gas cylinder 30 is variable. If the depression of the gas control pin 30*d* is released, the gas cylinder 30 prohibits move of the gas contained in the cylinder portion 30*a* to prohibit relative move of the piston portion 30*b* with respect to the cylinder portion 30*a*. A guide portion 26 is formed of an approximately tubular guide cylinder 26*a* and a guide piston 26*b* which is allowed to be inserted into the guide cylinder 26*a*. A gas cylinder operating portion 40 is fixed to the undersurface of the main body 10 in order to expand or contract the gas cylinder 30.

Figure 7:
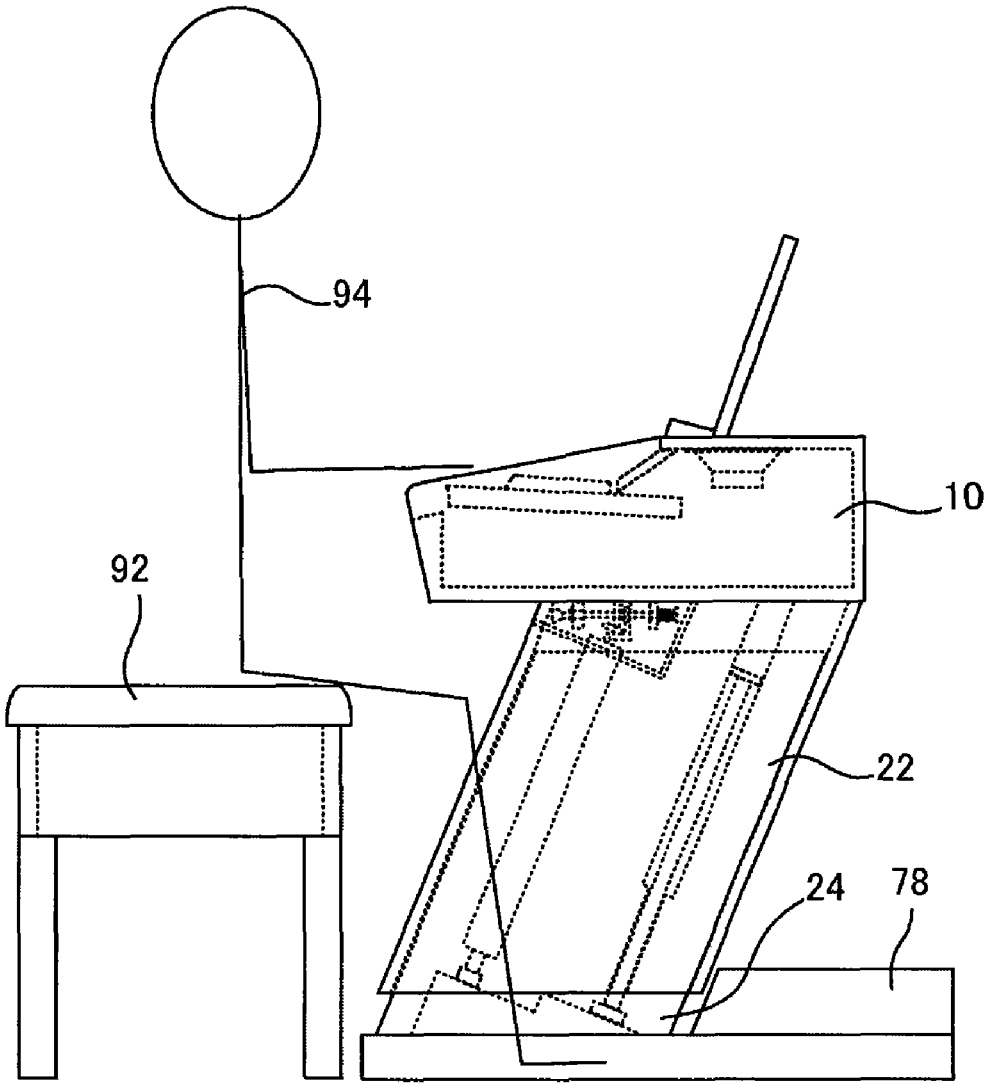
FIG. 7 is a right side view of the electronic keyboard instrument according to the third embodiment, the view showing the electronic keyboard instrument after the height thereof has been changed.

A flange portion 32 is formed to be approximately shaped like a letter L when viewed from the side. An aperture of the letter L points upward to be fixed to the undersurface of the main body 10. The top end of the guide cylinder 26*a* is fixed to the undersurface of the main body 10. The bottom end of the guide piston 26*b* is fixed to the base 28. The lower end of the piston portion 30*b* of the gas cylinder 30 is fixed to the base 28, while the top end of the cylinder portion 30*a* is fixed to the flange portion 32. Although FIG. 6 shows only the gas cylinder 30 and the guide portion 26 provided on the right side of the electronic keyboard instrument, a similarly configured gas cylinder and a similarly configured guide portion are provided on the left side as well. If the gas cylinder operating portion 40 is operated to lower the main body 10, the right side of the electronic keyboard instrument is seen as shown in FIG. 7. In FIG. 7, the main body 10 and the stool 92 are adjusted to have a height suitable for the child player 94.

Figure 8A:
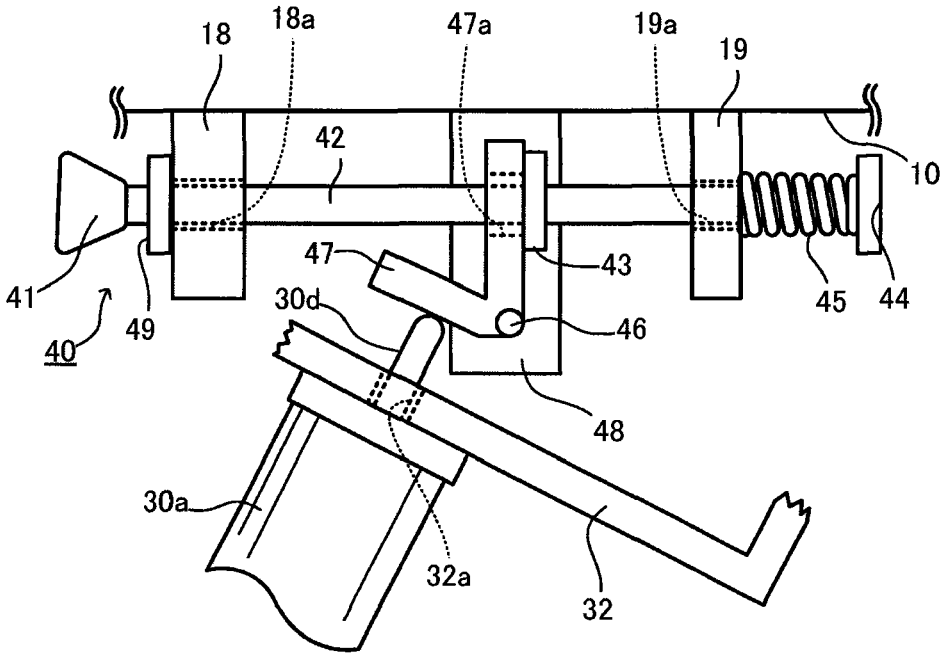
FIG. 8 is a right side view of a gas cylinder operating portion.

Detailed configuration of the gas cylinder operating portion 40 and the top end of the gas cylinder 30 will be given. In FIG. 8A, supporting members 18, 19 are formed to be shaped like an approximately rectangular plate. The supporting members 18, 19 jut from an approximately central portion in the horizontal direction (or left-right direction) of the undersurface of the main body 10. On the supporting members 18, 19, circular penetrating holes 18*a*, 19*a* are provided, respectively, the penetrating holes 18*a*, 19*a* penetrating in the thickness direction (in the left-right direction in the figure). A lever 42 is formed of an approximately long cylindrical metal rod, and is supported by the supporting members 18, 19. The lever 42 penetrates through the penetrating holes 18*a*, 19*a* so that the lever 42 can move frontward and backward with respect to the main body of the musical instrument (in the left-right direction in the figure).

To the front end (the left end in the figure) of the lever 42, a knob 41 held by a user is fastened. To positions located in between the knob 41 and the supporting member 18, at the approximately central part of the lever 42, and at the rear end of the lever 42, disc portions 49, 43, 44 are fixed so as to jut in the radial direction of the lever 42 to be shaped like a disc. The diameter of the disc portions 49, 43, 44 is larger than that of the penetrating holes 18*a*, 19*a*. In FIG. 8A, the disc portion 49 abuts on the supporting member 18. In between the disc portion 44 and the supporting member 19, a coil spring 45 passes through the lever 42 so that the both ends of the coil spring 45 abut on the supporting member 19 and the disc portion 44.

Figure 8B:
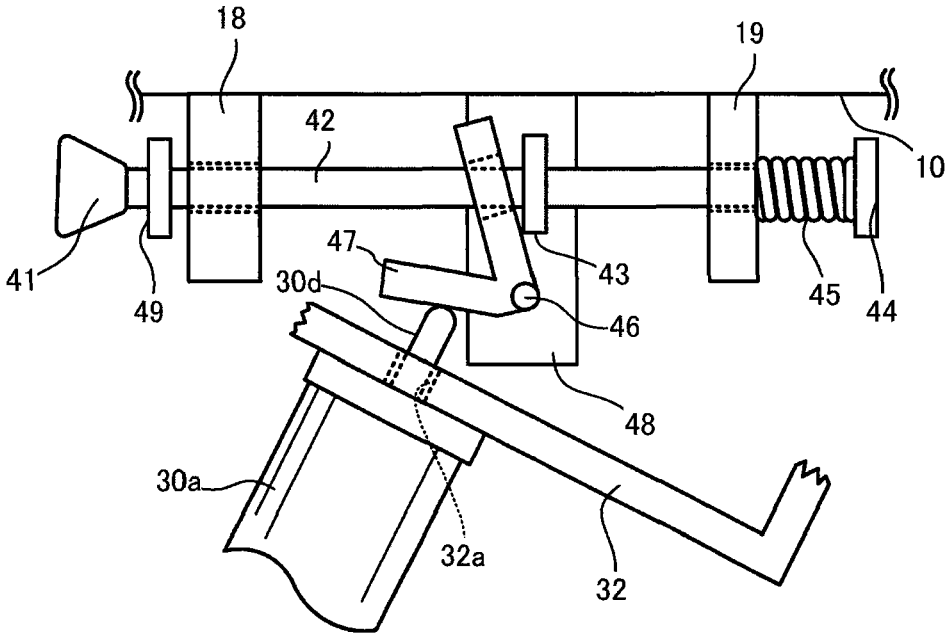

An operating plate 47 is formed by longitudinally bending a long rectangular metal plate in the shape of a letter V having an angle of about "60°". The operating plate 47 extends below the main body 10 in the left-right direction. The operating plate 47 is rotatably supported about a rotational axis 46 which is shown as perpendicular to the surface of the paper. A pair of axis supporting portions 48 juts from the undersurface of the main body 10 to fix the rotational axis 46 to the main body 10. The pair of axis supporting portions 48 is provided so as to sandwich the operating plate 47. In FIGS. 8A and 8B, however, only the left axis supporting portion 48 is shown. The operating plate 47 may be configured to be urged about the rotational axis 46 by a coil spring or the like which is not shown in a clockwise direction.

On the operating plate 47, a penetrating hole 47*a* whose diameter is smaller than that of the disc portion 43 is provided so that the lever 42 penetrates through the penetrating hole 47*a* at the front (left side in the figure) of the disc portion 43. The penetrating hole 47*a* may be a notch having an aperture which is smaller than the disc portion 43. The top end of the cylinder portion 30*a* of the gas cylinder 30 is fixed to a surface of the flange portion 32, the surface being orthogonal to the gas cylinder 30. As a result, the main body 10 is supported by the gas cylinder 30 through the flange portion 32. At the center of the top end of the cylinder portion 30*a*, a gas control pin 30*d* is provided in order to allow control of stroke of the cylinder by depression of the gas control pin 30*d*. The gas control pin 30*d* penetrates through a penetrating hole 32*a* provided on the flange portion 32 to jut upward with the top end of the gas control pin 30*d* abutting the undersurface of the operating plate 47.

In the above-described configuration, FIG. 8B shows a state where a user holding the knob 41 pulls the knob 41 toward him. In the shown state, the coil spring 45 sandwiched between the disc portion 44 and the supporting member 19 is contracted. Being pressed by the disc portion 43, the operating plate 47 turns about the rotational axis 46 in a counter-clockwise direction to depress the gas control pins 30*d* of the pair of gas cylinders 30 provided on both sides. As a result, the gas cylinders 30 become extendable and contractible. If the user adjusts the main body 10 to his desired height and then releases the knob 41, the gas cylinder operating portion 40 returns to its original state (FIG. 8A) due to springing force of the coil spring 45, resulting in the current height of the main body 10 being fixed.

d. Modified Examples

The present invention is not limited to the above-described embodiments, but may be modified variously as described below as examples:

(1) Although the first and third embodiments are not provided with anything which is equivalent to the pedal unit 80 of the second embodiment, the first and third embodiments may be also provided with a pedal unit. In order to make it easy for the child player 94 to operate, however, it is preferable to employ a pedal unit which is allowed to move frontward and backward.

(2) Although the above-described embodiments employ the screw holes 72*a*, 74*a* and screws 76 (the first and second embodiments) or the gas cylinder 30 (the third embodiment) as the mechanism for raising and lowering the main body 10, a screw raising/lowering mechanism in which screws or nuts are screwed to raise or lower the main body 10. Further, a ratchet raising/lowering mechanism may be employed in order to raise or lower the main body 10.

(3) Although the guide portion 26 employed in the third embodiment is formed of the guide cylinder 26*a* and the guide piston 26*b*, the guide member is not limited to the employed one. More specifically, a slide rail, a roller or a rack rail mechanism may be employed.

(4) In the above-described embodiments, the stand portions which support the main body 10 are divided into "two" to have the upper stand portions 72 (or 22) and the lower stand portions 74 (or 24). However, the stand portions may be divided into "three" or more. The further division makes it possible to even lower the minimum height of the main body 10. Particularly, the further division of the stand portions is preferable to the second embodiment.

(5) Although the second embodiment and the modified example of the first and third embodiments are provided with the plurality of pedals 62, . . . 62 as an example of "pedal", the "pedal" is not limited to the above-described ones but may be a pedal keyboard, an expression pedal and the like. Alternatively, only a pedal may be provided.

What is claimed is:

1. An electronic musical instrument comprising:

a main body having a keyboard operated with player's hands;

a lower stand portion being placed on a floor;

an upper stand portion supporting the main body at an upper portion of the upper stand portion, the upper stand portion being displaceably supported at a lower portion of the upper stand portion by the lower stand portion so that a height measured from the floor to the main body can be changed, the upper stand portion being designed such that the main body moves diagonally frontward if the height from the floor to the main body is lowered;

fixing means for fixing the upper stand portion to the lower stand portion so that the upper stand portion cannot be displaced after the height from the floor to the main body has been changed; and a pedal mounted on the lower stand portion and operated with a player's foot.

2. An electronic musical instrument according to claim 1 wherein the lower stand portion and the upper stand portion are provided on both right and left sides, respectively, as pairs.

3. An electronic musical instrument according to claim 1 wherein the closer to the top of the lower stand portion, the more the lower stand portion is tilted diagonally backward; and the upper stand portion is mounted on the lower stand portion so that the upper stand portion can be displaced in a direction in which the lower stand portion extends.

4. An electronic musical instrument according to claim 1 wherein the fixing means is a connecting member which connects the upper stand portion to the lower stand portion so that the lower stand portion and the upper stand portion cannot be displaced, respectively.

5. An electronic musical instrument comprising:

a main body having a keyboard operated with player's hands;

a lower stand portion being placed on a floor;

an upper stand portion supporting the main body at an upper portion of the upper stand portion, the upper stand portion being displaceably supported at a lower portion of the upper stand portion by the lower stand portion so that a height measured from the floor to the main body can be changed, the upper stand portion being designed such that the main body moves diagonally frontward if the height from the floor to the main body is lowered; and fixing means for fixing the upper stand portion to the lower stand portion so that the upper stand portion cannot be displaced after the height from the floor to the main body has been changed;

wherein the fixing means is a gas cylinder which connects the upper stand portion to the lower stand portion.

6. An electronic musical instrument according to claim 1 wherein the pedal is at least one of a damper pedal, a soft pedal, a sostenuto pedal, an expression pedal and a pedal keyboard.

7. An electronic musical instrument according to claim 5 wherein the lower stand portion and the upper stand portion are provided on both right and left sides, respectively, as pairs.

8. An electronic musical instrument according to claim 5 wherein the closer to the top of the lower stand portion, the more the lower stand portion is tilted diagonally backward; and the upper stand portion is mounted on the lower stand portion so that the upper stand portion can be displaced in a direction in which the lower stand portion extends.

9. An electronic musical instrument according to claim 1, wherein the fixing means is a gas cylinder which connects the upper stand portion to the lower stand portion.

* * * * *